US006047916A

United States Patent [19]

Önnerlöv

[11] Patent Number: 6,047,916

[45] Date of Patent: Apr. 11, 2000

[54] REEL-UP AND MULTI-FUNCTIONAL HANDLING DEVICE THEREFOR

[75] Inventor: Lars-Erik Önnerlöv, Karlstad, Sweden

[73] Assignee: Valmet-Karlstad AB, Sweden

[21] Appl. No.: 09/268,464

[22] Filed: Mar. 16, 1999

Related U.S. Application Data

[60] Provisional application No. 60/081,325, Apr. 10, 1998.

[30] Foreign Application Priority Data

Mar. 16, 1998 [SE] Sweden ..... 9800838

[51] Int. Cl.[7] ..... B65H 19/22

[52] U.S. Cl. ..... 242/533.1; 242/533.2; 242/533.3; 242/533.7; 242/534

[58] Field of Search ..... 242/533.1, 533.2, 242/533.3, 533.4, 533.7, 534

[56] References Cited

U.S. PATENT DOCUMENTS

| | | | |
|---|---|---|---|
| 3,062,465 | 11/1962 | Hunter | 242/533.1 X |
| 3,586,253 | 6/1971 | Gilbank | 242/533.1 |
| 4,390,138 | 6/1983 | Rohde et al. . | |
| 4,428,543 | 1/1984 | Kuhn . | |
| 4,431,142 | 2/1984 | Kataoka | 242/533.3 |
| 4,744,526 | 5/1988 | Kremar | 242/533.2 X |
| 4,768,730 | 9/1988 | Laine | 242/533.2 |
| 4,778,122 | 10/1988 | Snygg | 242/533.1 |
| 4,905,925 | 3/1990 | Kremar | 242/533.1 |
| 5,941,474 | 8/1999 | Cushing | 242/533.1 |

FOREIGN PATENT DOCUMENTS

| | | |
|---|---|---|
| 0 244 059 | of 0000 | European Pat. Off. . |
| 2 188 619 | of 0000 | United Kingdom . |
| WO97/47547 | of 0000 | WIPO . |

*Primary Examiner*—Donald P. Walsh
*Assistant Examiner*—Minh-Chau Pham
*Attorney, Agent, or Firm*—Alston & Bird LLP

[57] ABSTRACT

A reel-up in a paper machine in which the web is reeled onto reeling drums provided with cores, the reel-up having an upper pair of parallel rails extending from the downstream end of the reel-up to its upstream end to support a stock of reeling drums provided with cores, and a handling station for handling finished reels of paper, reeling drums and cores, the handling station having a vertically movable lifting table for receipt of a finished reel of paper, a device for moving a reeling drum out from a reel of paper on the lifting table and for subsequently inserting the reeling drum into at least one core on the lifting table, and a device for feeding cores out onto the lifting table. According to the invention the handling station is provided with a lifting device comprising two lifting elements arranged to be brought into engagement with a reeling drum provided with core(s) and situated on the lifting table, and to lift this and deliver it to the upper pair of rails. Actuators are connected to the lifting elements to move them from the lifting table to the delivery point at the upper pair of rails.

17 Claims, 10 Drawing Sheets

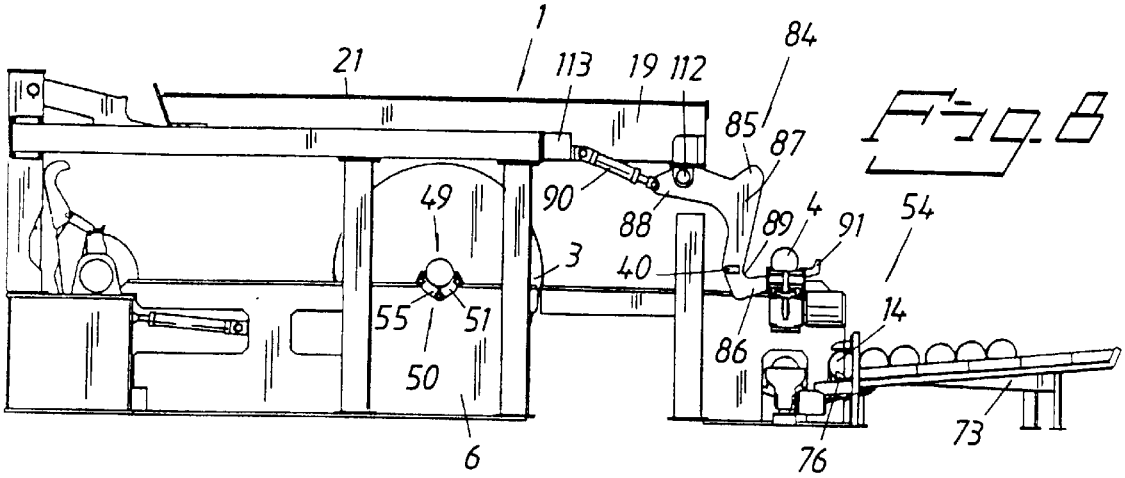
Fig. 8
Fig. 9
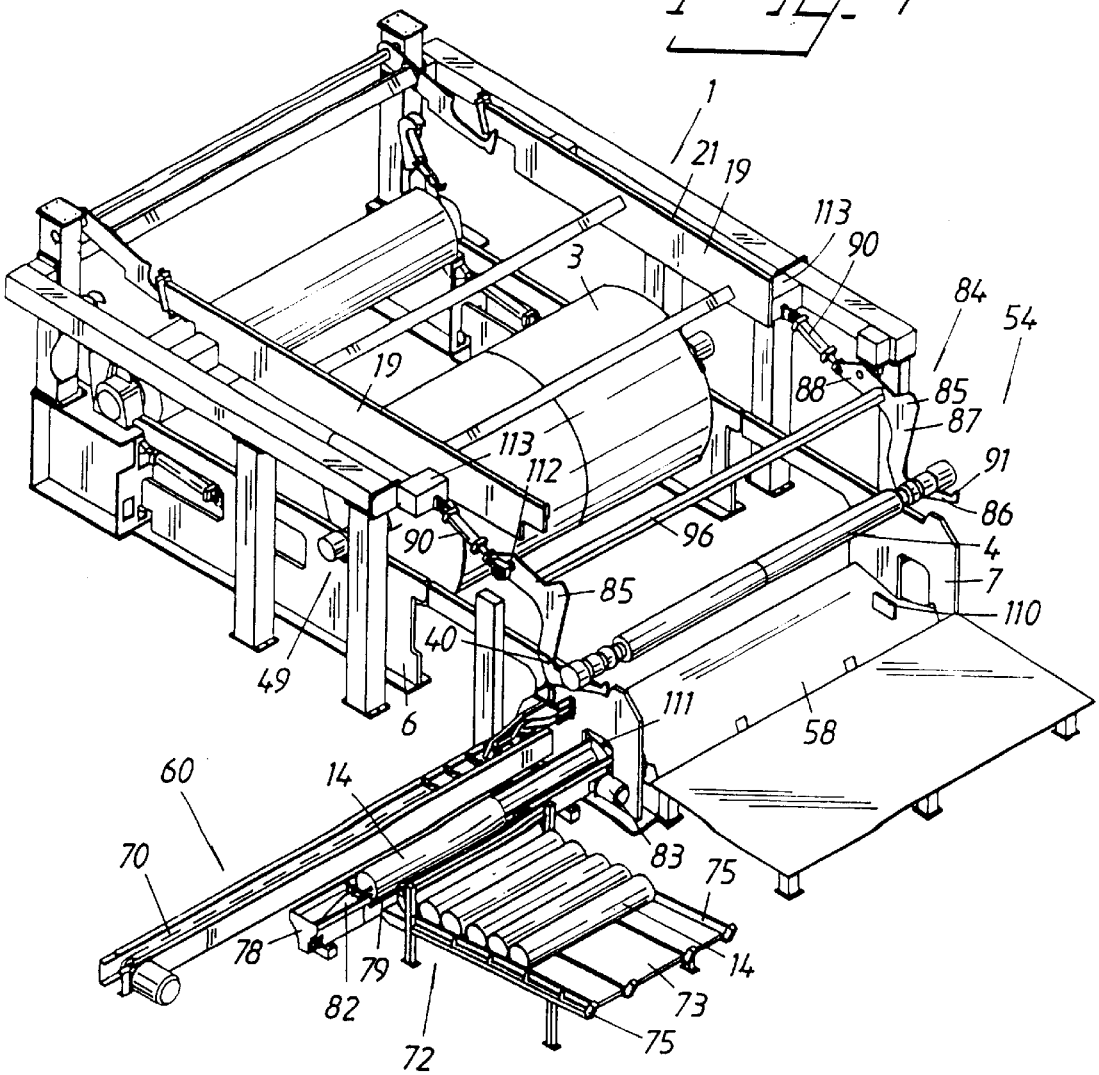

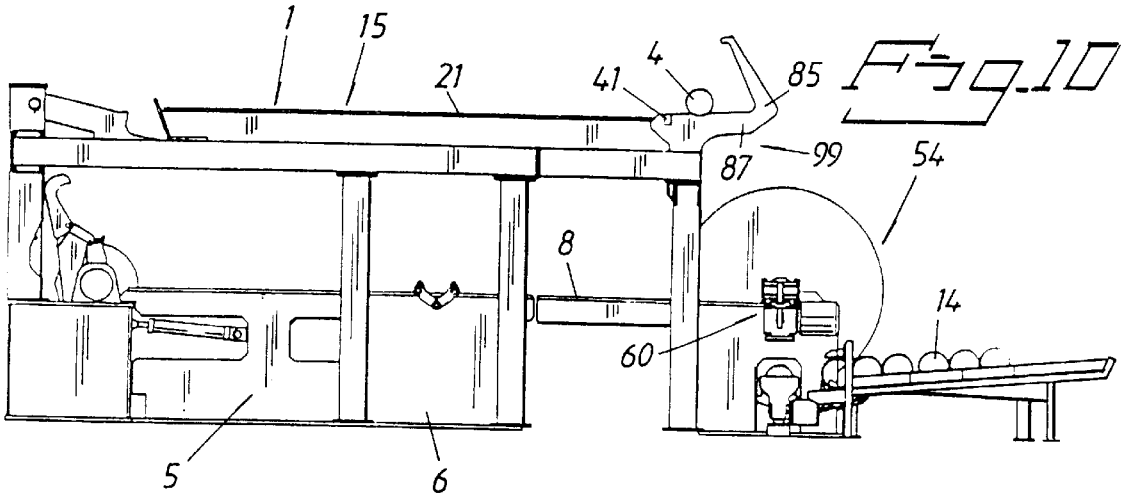
Fig. 10
Fig. 11
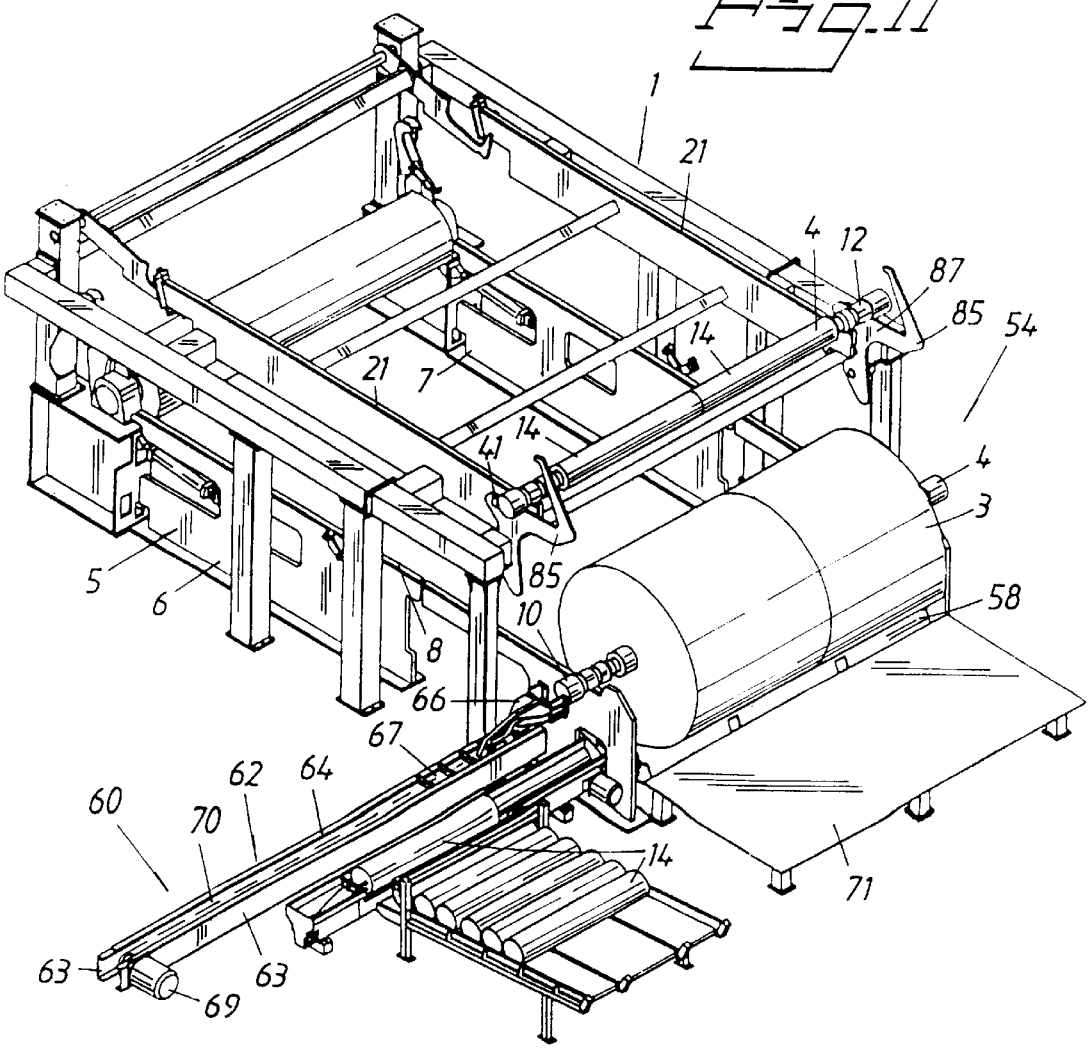

15
30
31
23
1
21
98
4
29
19
113
84
91
98
87
86
93
92
94
85
112
88
14
21
19
113
91
86
96
54
41
98
87
14
4
56
94
92
40
90
95
85
89
88
7
56
57
6

REEL-UP AND MULTI-FUNCTIONAL HANDLING DEVICE THEREFOR

CROSS-REFERENCE TO RELATED APPLICATION

The present application claims the benefit of the filing date of commonly owned U.S. Provisional Patent Application Ser. No. 60/081,325 filed Apr. 10, 1998.

FIELD OF THE INVENTION

The present invention relates to paper making machines and, more particularly, to a reel-up in a paper machine for reeling a paper web onto reeling drums provided with cores to form reels of paper.

BACKGROUND OF THE INVENTION

A reel-up for a paper machine typically includes a pair of upper rails for supporting a stock of reeling drums each provided with one or more paper reel cores, and a pair of lower rails below the upper rails and having an upstream end proximate a reeling device operable to reel a web of paper onto a reeling drum and to roll a finished reel of paper along the lower rails to a downstream end of the reel-up. The reel-up usually includes a device for lowering a reeling drum from the upper rails into engagement with the reeling device, whereupon the paper web is reeled onto the reeling drum until the reel reaches a predetermined size. At that point, the finished paper reel is disengaged from the reeling device and is rolled along the lower rails to a downstream end of the reel-up.

Some reel-ups also include one or more devices for removing a reeling drum from the finished paper reel and for inserting the removed reeling drum into one or more new empty cores so that the reeling drum can be placed back into the stock of reeling drums on the upper rails.

The finished reel of paper leaving the reel-up is usually called a jumbo roll. This may either consist of a single reel with a breadth corresponding to the full machine breadth, or of several reels, the paper web being divided into two or more web sections which are reeled individually onto a like number of cores installed on a common reeling drum. To achieve a continuous production of paper reels, empty reeling drums are continually supplied from a stock of drums. This stock of drums is arranged in close connection to the surface winding drum at the upstream end of the reel-up and at a level just above the production line of the reel-up in order to save space. The reeling drums are lowered from the stock of drums with the aid the lowering device to a surface winding drum of the reel-up where the process of reeling the paper web to finished reel of paper again commences.

The stock of drums must be replenished as the reeling drums are used in the reel-up. In conventional reels-up a manual system is still used to a great extent to return the reeling drum removed from the finished paper reel to the stock of reeling drums. This is achieved by pulling or pressing the reeling drum out of the paper reel with the aid of a drum moving device arranged at the downstream end of the reel-up. The reeling drum thus removed is then provided with one or more new cores and returned to the stock of drums. The cores have comparatively very large diameter as well as a length usually reaching several meters and cannot therefore be moved manually to any great extent. They must therefore be transported to the reel-up with the aid of an overhead crane or some other suitable transport device, such as a truck. The reeling drum provided with a core is lifted by an overhead crane to the drum stock situated above the reel-up, a machine operator first manually applying the gripping means of the crane on the reeling drum selected and accompanying the reeling drum along its transport distance until it can be placed in the correct position in the drum stock. Alternatively, a second machine operator may be positioned up by the drum stock to receive and disengage the raised reeling drum. It will be readily understood that the manual manipulation of the reeling drums described above is both time-consuming and laborious, and thus expensive. Furthermore, all manual work in or close to the paper machine during operation including transport of heavy objects such as reeling drums suspended in overhead cranes, always entails risks for the operator. Since handling of the reeling drums takes place inside the machinery hall, the machine operators whose job it is to look after the manual manipulation of the reeling drums are subjected to potential accident risks, noise, and other stress situations. It is therefore highly desirable to reduce manual handling of the reeling drums.

One object of the present invention is therefore to provide an improved reel-up which enables manual handling of the reeling drums to be greatly reduced.

SUMMARY OF THE INVENTION

The invention provides a reel-up in which it is possible to move the reeling drums in an automatic cycle, i.e. without manual help during the actual transfer and without the use of external handling equipment and vehicles for transfer of the reeling drums in the cycle. The only manual assistance entails activation and de-activation of the engagement between the cores and the reeling drums. However, this has nothing to do with the actual movement of the reeling drums in the cycle.

To these ends, a reel-up in accordance with a preferred embodiment of the invention comprises a pair of parallel lower rails extending from the upstream end to the downstream end of the reel-up and adapted to support opposite end portions of a reeling drum and to permit the reeling drum to roll along the rails; a pair of parallel upper rails spaced above the lower rails and extending from the downstream end to the vicinity of the upstream end, the upper rails being adapted to support a stock of reeling drums having opposite end portions arranged to roll along the upper rails; a reeling station arranged immediately downstream of the upstream end proximate the lower rails and operable for reeling the paper web onto a reeling drum; and a multi-functional handling station situated at the downstream end for handling finished reels of paper, reeling drums and cores.

The handling station preferably comprises a drum-moving device operable to engage an end portion of a reeling drum in a finished reel of paper and to remove the reeling drum from the finished reel of paper, and further operable to insert the removed reeling drum into one or more empty cores aligned with the drum moving device; a lifting table constructed and arranged to receive and support the finished reel of paper, the lifting table being movable for aligning the reeling drum of the finished reel with the drum-moving device to permit removal of the reeling drum therefrom, the lifting table being further movable to align one or more empty cores with the drum-moving device to permit insertion of the reeling drum therein to; a core-feeding device operable for automatically feeding empty cores out onto the lifting table following removal of a finished reel of paper from the lifting table; and a lifting device operable to engage the end portions of a reeling drum provided with at least one empty core and situated on the lifting table, and to lift the reeling drum and deliver it to the upper rails.

The multi-functional handling device thus facilitates a greater use of automated handling of the reeling drums and cores so that reduced risk of injury to operators and improved handling speed can be achieved.

BRIEF DESCRIPTION OF THE DRAWINGS

The invention will be described in more detail in the following with reference to the drawings.

FIG. 8 shows a schematic side view of the reel-up of FIG. 1, depicted in a still further operating position.

FIG. 9 shows a schematic perspective view of the reel-up in the further operating position corresponding to FIG. 8.

FIG. 10 shows a schematic side view of the reel-up of FIG. 1, depicted in a still further operating position.

FIG. 11 shows a schematic perspective view of the reel-up in the further operating position corresponding to FIG. 10.

FIG. 16 shows a schematic side view of parts of the reel-up and its handling station at the downstream end of the reel-up.

DETAILED DESCRIPTION OF THE INVENTION

Figure 1:
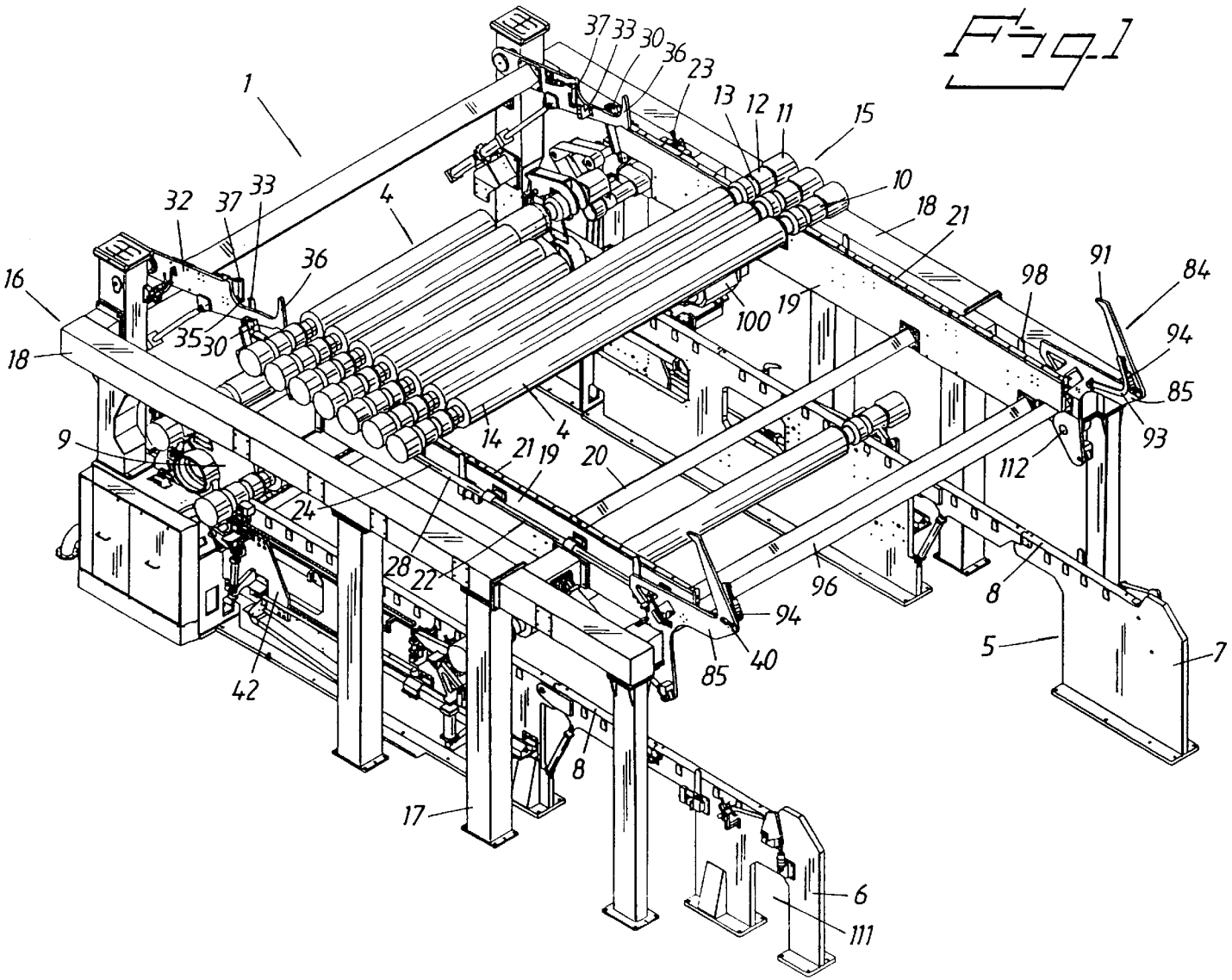
FIG. 1 shows schematically a view in perspective of parts of a reel-up in a paper machine, seen downstream from the operator side, the reel-up having a handling station of which only the lifting device according to the invention is shown.
Figure 2:
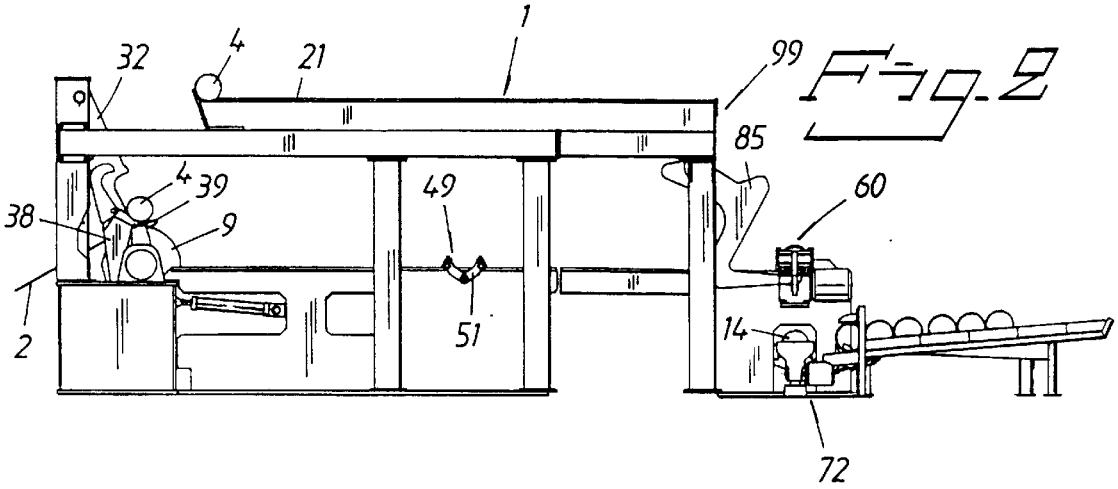
FIG. 2 shows a schematic side view of the reel-up of FIG. 1, depicted in an initial operating position.
Figure 3:
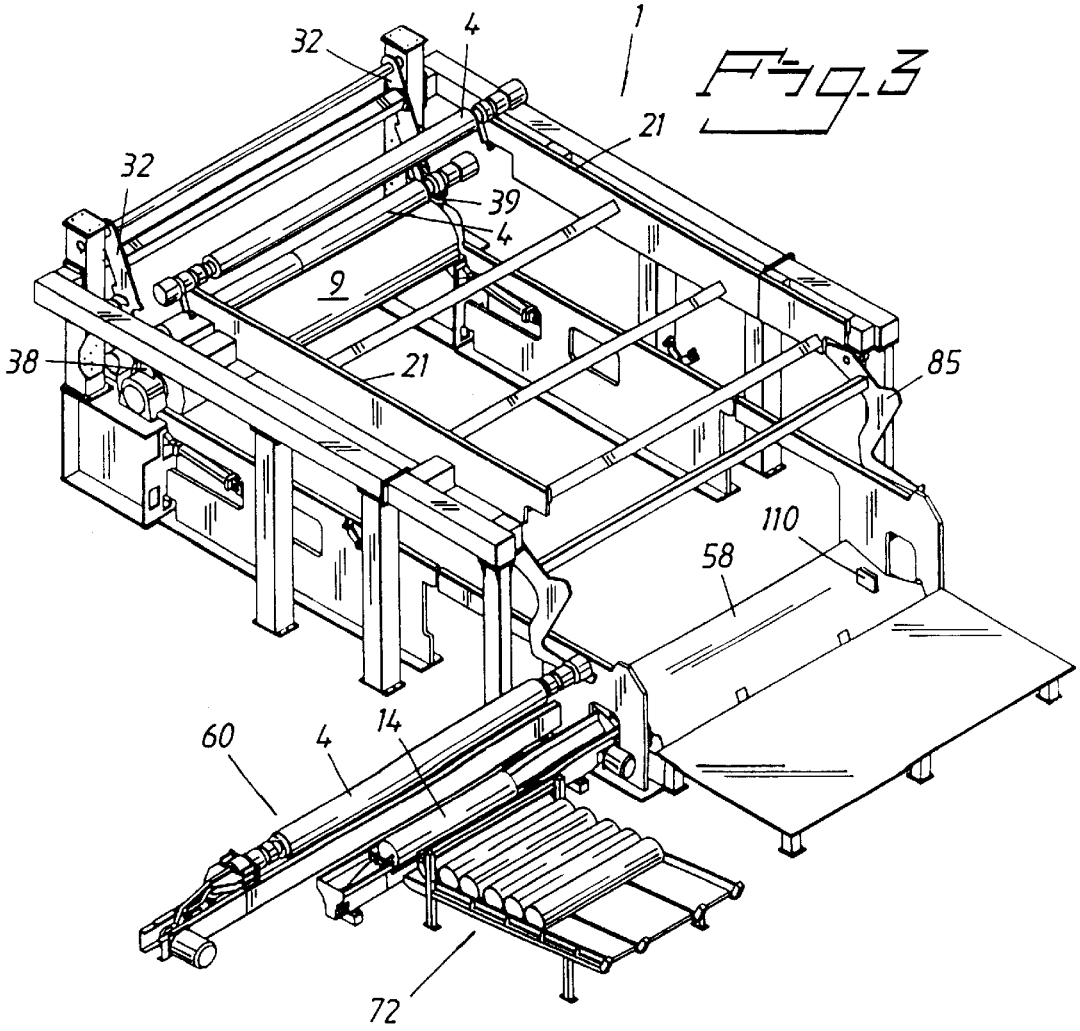
FIG. 3 shows a schematic perspective view of the reel-up of FIG. 1, depicted in the initial operating position.
Figure 4:
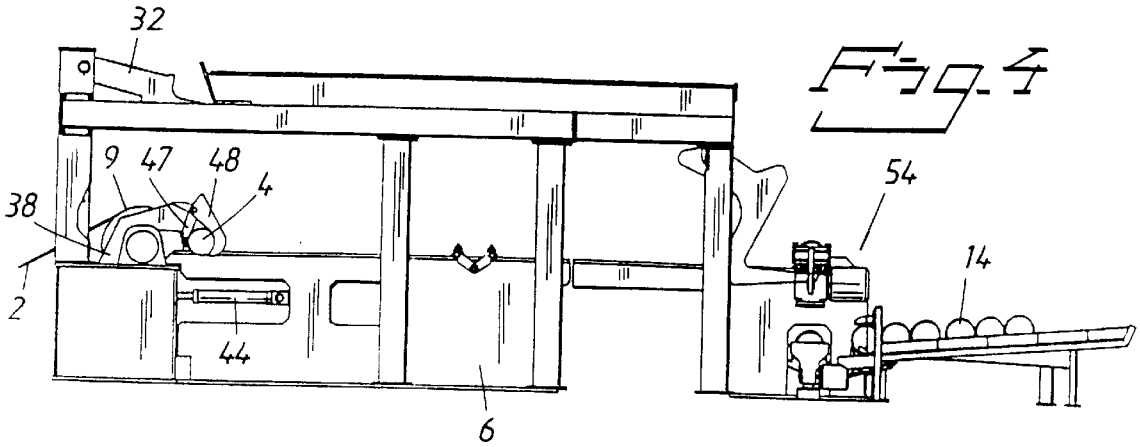
FIG. 4 shows a schematic side view of the reel-up of FIG. 1, depicted in a further operating position.

FIG. 1 shows schematically in perspective parts of a reel-up 1 in a paper machine in which paper is manufactured in a continuous web 2 which is reeled onto a rotatable reeling drum 4 in the reel-up 1 to form a reel of paper 3. The reel-up 1 comprises a stand 5 with first and second longitudinally extending, parallel stand parts 6, 7 along which the paper reels 3 roll on top of horizontal rails 8 rigidly mounted above each stand part 6, 7 and forming a lower pair of rails in the reel-up. The reel-up has a reeling station arranged immediately downstream of the upstream end of the reel-up. In the embodiment shown the reeling station is constructed as follows. A surface winding drum 9 is rotatably journalled at the stand parts 6, 7 in the upstream end of the reel-up 1. A drive means (not shown) gives the surface winding drum 9 a peripheral speed corresponding to the speed of the paper web 2. The stand rails 8 are arranged at a distance from each other which is somewhat greater than the breadth of the paper web 2. The reeling drum 4 is provided at each end with a braking drum 10 comprising a coupling member 11 and a bearing housing 12 situated inside the coupling member 11, provided with a peripheral groove 13. The reeling drum 4 rolls along the stand parts 6, 7, its peripheral grooves 13 cooperating with the stand rails 8. In the embodiment shown each reeling drum 4 is provided with two form-stable cylindrical cores 14. Alternatively only one core may be used, as shown in FIG. 1. The reeling drum 4 has expandable plates which in active state, i.e. expanded, lock the cores 14 to the reeling drum and which in inactive state, i.e. unexpanded, release the core from the reeling drum.

The reel-up stand is provided with a horizontal, frame-like top stand part 16 supported by a plurality of pillars 17 and comprising two parallel beams 18 extending in machine direction. A support element 19 is arranged on the inside of each beam 18 and rigidly joined to this by crossbars 20. The support elements 19 are spaced from the beam 18 and provided with rails 21 situated at a higher level than the beams 18. The rails 21 are arranged to carry reeling drums 4 provided with cores, these drums forming a stock 15 for the continuous operation of the reel-up. Like the lower rails 8, the upper rails 21 are dimensioned to fit with clearance into the peripheral grooves 13 of the reeling drums 4. The upper rails 21 and lower rails 8 are situated in pairs in a common vertical plane. The reel-up is provided with a feeding device 22 for feeding a reeling drum 4 along the rails 21 when the reeling drum has been lifted and placed on the rails 21. The feeding device 22 comprises a feeder 23 arranged close to each rail 21 to be brought into abutment with a reeling drum when it is to be fed forward. The feeding device also comprises a pneumatic actuator 24 arranged on the outer side of each support element 19 to move the feeder 23 to and fro along the rail 21. It will be understood that the two actuators 24 are synchronised with each other. In the embodiment shown the actuator 24 consists of a cylinder 28 and a piston (not shown) movable therein, with which the feeder 23 is connected via a connection piece 25 (see FIG. 16), extending through a longitudinally extending, self-sealing groove (not shown) in the cylinder 28. The feeder 23 is pivotably arranged to be swung down to an inactive position under the influence of a reeling drum 4, when the feeder 23 is returned to fetch this reeling drum. The feeder 23 is arranged to be automatically swung up to its active position by means of springs. Counterweights may be used instead of springs. An end stop 30 is arranged at each rail 21 to stop the forward feeding when the reeling drum 4 encounters the end stop 30. Detectors 31 (see FIG. 17) are also provided close to these end stops 30, arranged on the inner side of the support elements 19, to detect the presence and position of the foremost reeling drum 4.

Figure 14:
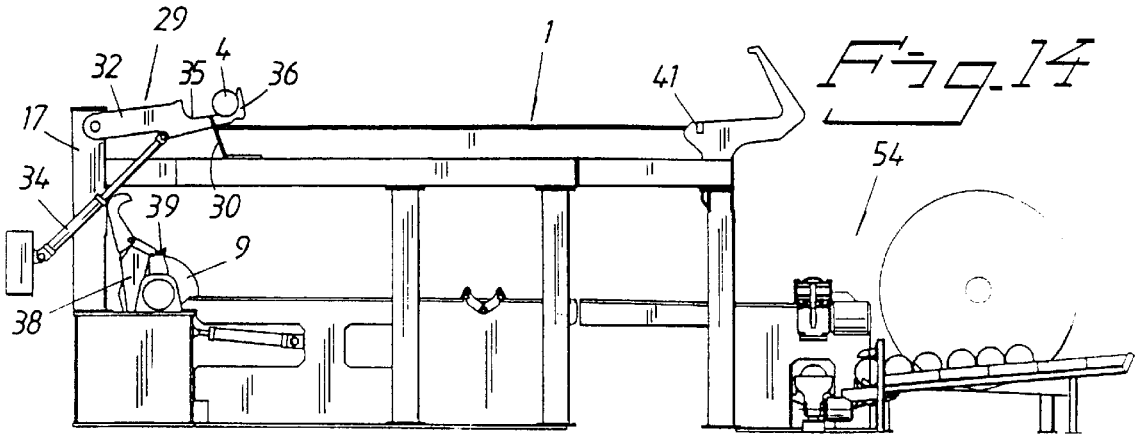
FIG. 14 shows a schematic side view of the reel-up of FIG. 1, depicted in a still further operating position.
Figure 15:
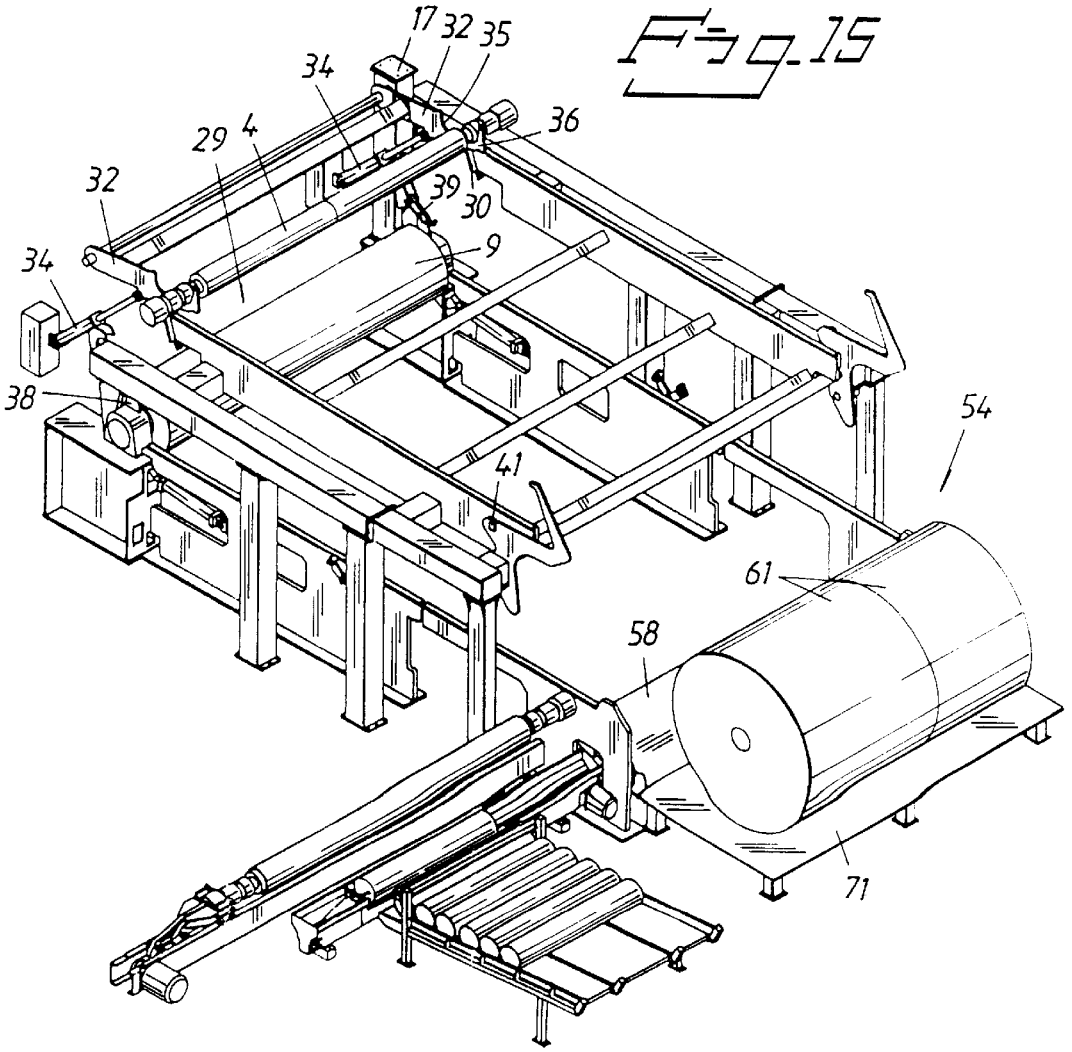
FIG. 15 shows a schematic perspective view of the reel-up in the further operating position corresponding to FIG. 14.
Figure 1B:
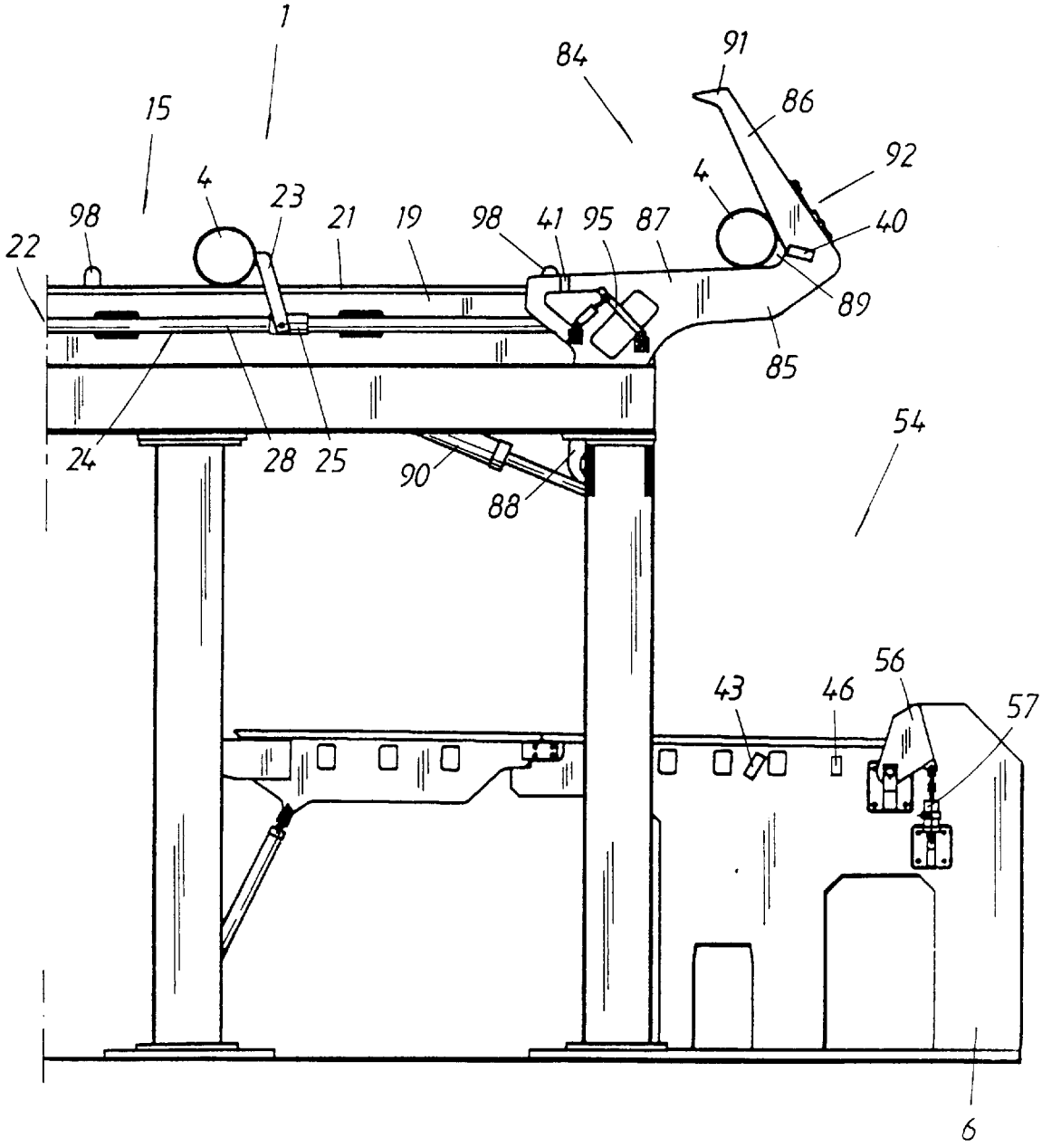

At its upstream end the reel-up is provided with a pair of lowering arms 32 (see FIGS. 14 and 15), which are pivotably mounted on the pillars 17 located there. With the aid of these lowering arms 32 a reeling drum 4 is transferred from the exit 29 of the drum stock 15 down to a primary system for receipt of a reeling drum 4 which is arranged in connection with the surface winding drum 9. A pair of actuators 34 is arranged at the lowering arms 32, extending between each one lowering arm 32 and the stand part 6, 7, respectively.

Each lowering arm 32 comprises a roll surface 35 extending along the upper edge of the arm 32 from its free, outer end and being defined by an outer grab hook 36 and an inner drum shock absorber 37 (see FIG. 1). A detector 33 is also arranged at each drum shock absorber 37 to detect when the reeling drum 4 gripped by the grab hook 36 and lifted by the lowering arm 32 has rolled along the roll surface 35 to the desired position before the lowering arm 32 returns to the primary system for receiving the reeling drum 4. The receiving primary system (see FIGS. 2–5) comprises two primary arms 38 arranged to receive the new reeling drum 4 either directly from the lowering arms 32 or from a pair of lowering surfaces 39 arranged at each end of the surface winding drum 9 and on a level with its upper side, when the paper reel 3 growing around the reeling drum 4 situated downstream approaches a certain predetermined size (see FIG. 6).

Figure 6:
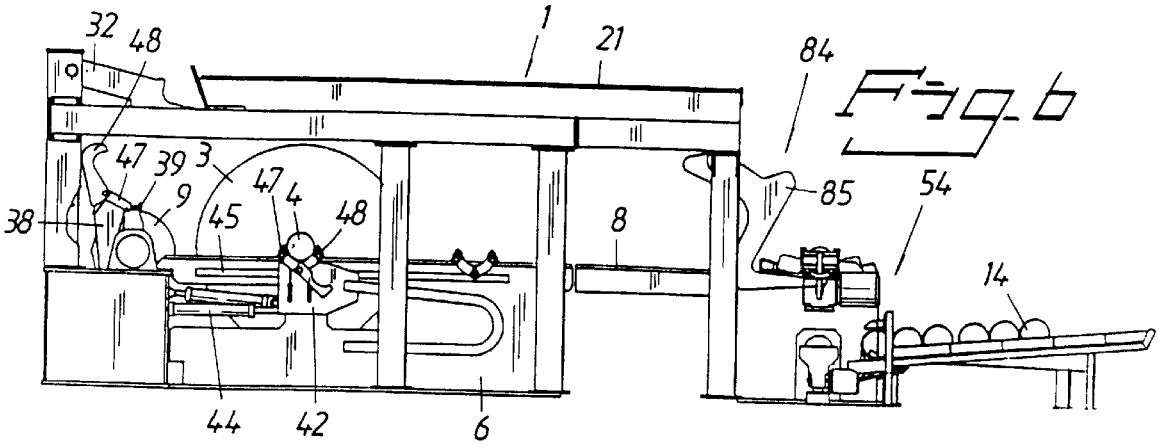
FIG. 6 shows a schematic side view of the reel-up of FIG. 1, depicted in a still further operating position.
Figure 7:
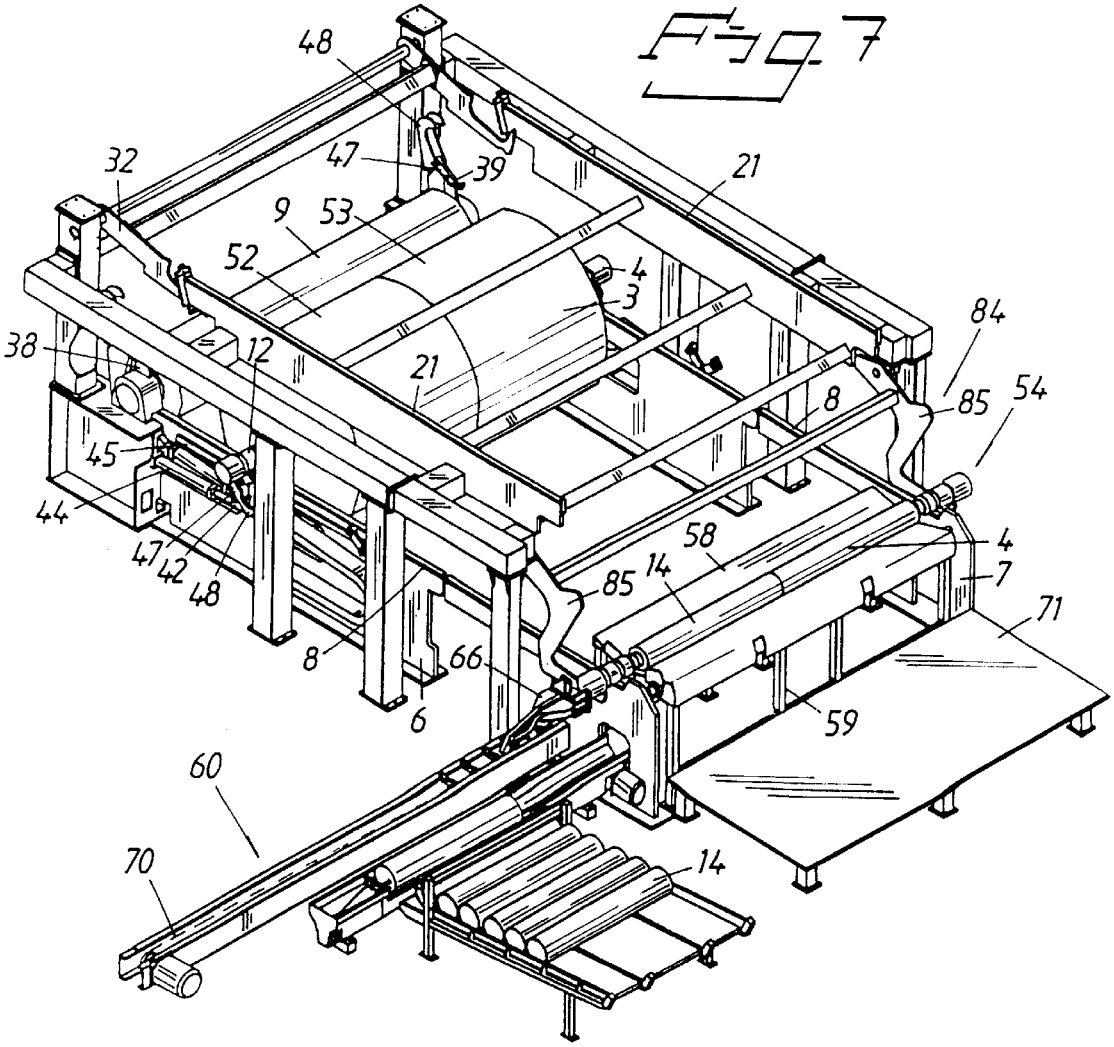
FIG. 7 shows a schematic perspective view of the reel-up in the further operating position corresponding to FIG. 6.

The reel-up 1 further comprises a secondary system having a pair of linearly movable secondary carriages 42 (see FIGS. 6 and 7) which are displaceable by means of actuators 44 along a track or tracks 45 at each stand part 6, 7. The primary arms 38 are arranged to bring the reeling drum 4 into contact with the surface winding drum 9 over which the paper web 2 runs, in order to commence reeling of the paper web 2. While a number of turns of the paper web 2 are wound onto the reeling drum 4, the latter is conveyed by the primary arms 38, along the periphery of the surface winding drum 9 down to the stand parts 6, 7, see FIGS. 4 and 5, where the secondary system is arranged to take over control of the reeling drum 4 during continued reeling. The actuator 44 for the secondary carriage 42 (see FIG. 6) consists of a hydraulic or pneumatic cylinder which is secured by one end to the secondary carriage 42 and by its other end to the stand 6, 7. The movements of the two secondary carriages 42 along the tracks 45 are thus synchronised with each other and with the increasing diameter of the paper reel 3 so that the secondary carriages 42 follow the paper reel 3 along its horizontal movement during the continued reeling to a finished jumbo roll 3.

Each primary and secondary system comprises gripping members formed by a locking device 47 and a press device 48. The gripping members support the reeling drum 4 while at the same time allowing it to rotate freely inside the gripping members. The gripping members of the secondary system are arranged to receive the reeling drum 4 from the gripping members of the primary system so that the end parts of the reeling drum 4 rest with their bearing housings 12 directly on the rails 8. They may alternatively rest on separate rails. The press device 48 is arranged to act against the bearing housing 12 during reeling, so that a desired and adjustable linear pressure is maintained in the nip between the surface winding drum 9 and the growing paper reel 3. A central drive 100 for the reeling drum 4 is also arranged at the secondary system (see FIG. 1) which means that the reeling drum 4 can be connected to a separate drive member via the opposite coupling device 11 of the reeling drum 4. Since this drive member is mounted on one of the secondary carriages 42, it is linearly displaceable together with these in a direction parallel to the rails 8. A braking station 49 is also arranged at the downstream end of the reel-up 1 (see FIGS. 8 and 9), at which braking station 49 the paper reel 3 arrives when reeling has been completed and after the paper web 2 has been cut. In the braking station 49 the paper reel 3 is retarded to stand-still by a braking device 50 mounted at each stand part 6, 7. The braking device 50 comprises braking arms 51 with associated actuators and brake linings. The cut end of the web is also taped to the surface of the jumbo roll 3 in the braking station 49. The braking station 49 also comprises an ejection device 55 which causes the paper reel 3 to roll towards the downstream end. A stop 56 and a shock absorber 57 are provided at the downstream-end of each stand part 6, 7 to restrain the horizontal movement of the paper reel 3 (see FIGS. 16 and 17).

Figure 5:
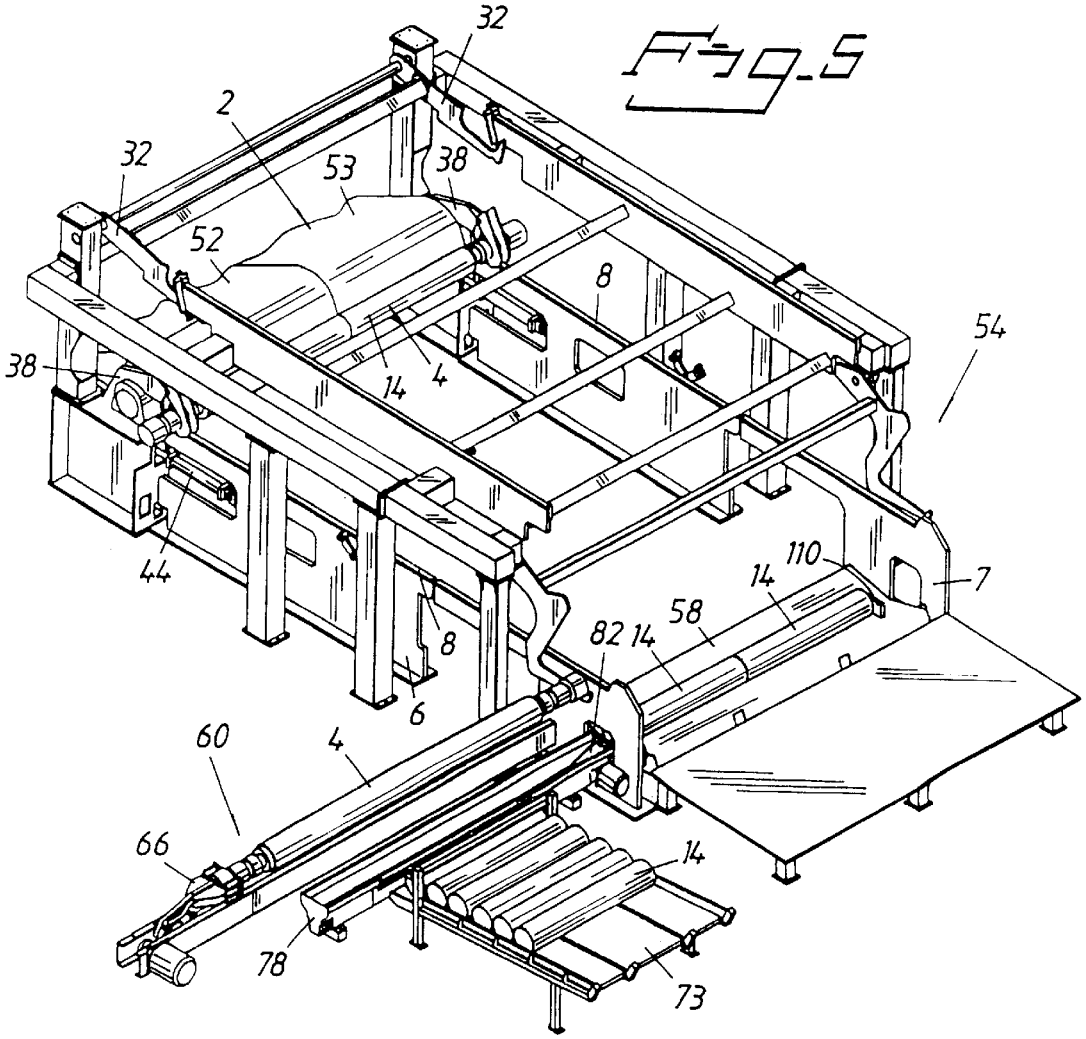
FIG. 5 shows a schematic perspective view of the reel-up in the further operating position corresponding to FIG. 4.

Upstream of the surface winding drum 9 is a cutting device, not shown, which slits the paper web 2 into two web sections 52, 53, see FIG. 5, having substantially the same breadth as the length of the cores 14 threaded onto the reeling drum 4, thus allowing each web section 52, 53 to be reeled onto its own core 14.

The reel-up also comprises a multi-functional handling station 54 situated at its downstream end for handling finished reels of paper 3, reeling drums 4 and cores 14 therefor. The handling station 54 comprises a lifting table 58 (see FIG. 7) extending between the stand parts 6, 7 such that the table is vertically movable and tiltable with the aid of a plurality of vertical actuators 59 distributed along its long sides. The lifting table 58 is provided on its upper side, in vicinity of the driving side, with suitable core stops 110.

The handling station 54 also comprises a device 60 for axial displacement of a reeling drum 4 (see FIG. 11). This drum moving device 60 is situated on the operator side of the reel-up, aligned with the lifting table 58, and comprises a longitudinally extending, horizontal support element 62 arranged at right angles to the machine direction and formed by two parallel U-shaped rails 63, the top surfaces 64 of which form sliding surfaces for the reeling drums 4. Between them the rails 63 define a space for receiving a carriage 67 slidingly journalled on the rails 63. The carriage 67 supports a gripping member 66 for detachable connection to the opposing end portion of a reeling drum 4. A motor 69 is mounted at the outer end part of the support element 62 to drive a cogged belt 70 rigidly connected to the carriage 67 to move the carriage to and fro in the support element 62.

Figure 13:
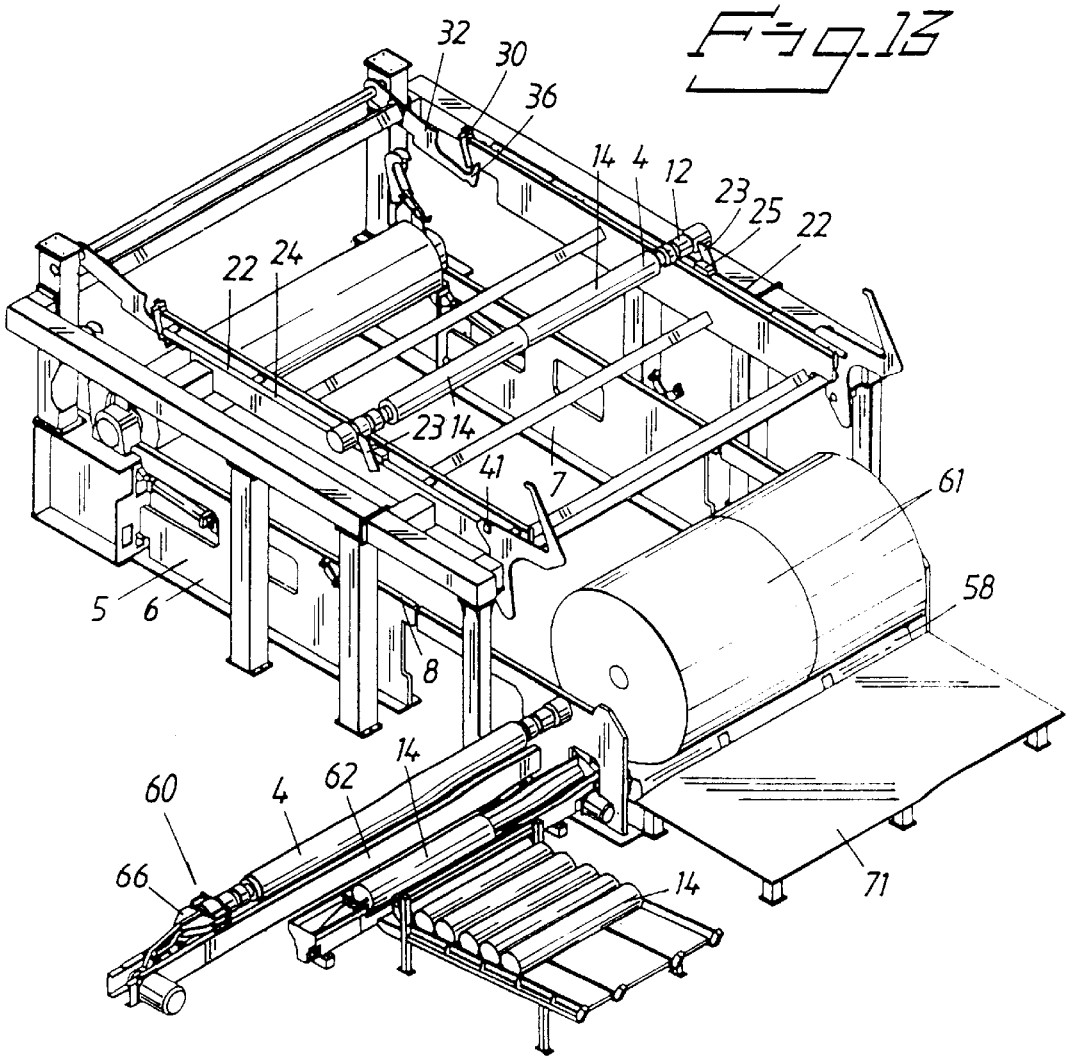
FIG. 13 shows a schematic perspective view of the reel-up in the further operating position corresponding to FIG. 12.

The lifting table 58 has concave or arched form (see FIG. 13) so that the two jumbo rolls 61 formed after withdrawal of the reeling drum 4 are safely retained. The lifting table 58 is also arranged, with the help of actuators 59, to tip the jumbo rolls 61 in downstream direction either directly to a suitable transport device (not shown), such as a travelling carriage or a conveyor belt, or to a bench 71 (see FIGS. 7 and 15) from which the jumbo rolls 61 are then transported further, either to a subsequent work station usually including some type of conversion or rewinding station, or to intermediate storage with the aid of an overhead crane or truck, for instance. The cores are then returned from this station to the reel-up.

The handling station 54 further comprises a core-feeding device 72 (see FIG. 9) provided with a horizontal, longitudinally extending channel 78 arranged at right angles to the machine direction and situated below the drum moving device 60. The channel 78 is open at its inner end, situated in an opening 111 in the stand part 6. A feeder 82 is slidably journalled in the channel 78. A motor 83 is mounted at the inner end portion of the channel 78 to drive a cogged belt (not shown) which is rigidly connected to the feeder 82 in order to move the feeder 82 to and fro in the channel 78. The starting position of the feeder 82 is behind the core 14 and, when actuated, it will press against the rear end of the core 14 to feed it through the opening 111 in the stand part 6 and out onto the lifting table 58. One side wall of the channel 78 is provided with an inlet opening 79 which is slightly longer than a core 14. The core-feeding device 72 is also provided with a magazine for cores 14 to be used. The magazine includes a ramp 73 arranged opposite the inlet opening 79 of the channel 78 and inclined towards this opening. The ramp 73 is provided with side plates 75 towards which the ends of the cores face and which serve as guides for the cores 14. A stop mechanism 76 (see FIG. 8) is arranged at the outlet end of the ramp 73 which in closed position retains the cores 14 on the ramp 73 and in open position allows the lowermost core 14 to roll down into the channel 78, after which it returns to closed position. The core-feeding device 72 comprises control equipment (not shown) with associated detectors at the inlet and outlet openings for the stored cores.

The handling station 54 further comprises a lifting device 84 to lift a reeling drum 4 provided with core(s) from the lifting table 58 to the drum stock 15 at the top of the reel-up (see FIGS. 8, 9, 16, 17). The lifting device 84 comprises two lifting elements 85, in the embodiment shown constituting Z-shaped lifting arms pivotably journalled each in its own support element 19. Each lifting arm is made in one piece and has an outer lifting arm part 86, an inner lifting arm part 87 and an inner journalling part 88. The two lifting arm parts 86, 87 and the journalling part 88 together form the Z-shape. The outer and inner arm parts 86, 87 form an acute angle with each other and define a V-shaped pocket 89 between them for receipt of an end portion of a reeling drum 4. The inner lifting arm part 87 and the journalling part 88 form substantially a right angle with each other. An actuator 90 in the form of a power cylinder is joined by one end to the inner journalling part 88 spaced from its journalling shaft 112 and with its other end at an attachment element 113 rigidly mounted on the support element 19 (see FIGS. 8 and 9). The force lines of the power cylinders 90 are in their extensions situated at a distance from the journalling shafts 112 of the lifting arms 85 so that the requisite leverage is obtained when activating the lifting arms 85. The free end of the outer lifting arm part 86 is provided with an upwardly directed stop 91, seen in the lower starting position of the lifting arm, to retain a reeling drum 4 on the outer lifting arm part 86 when lifting is to commence. The lifting arms 85 are joined together by means of a parallel shaft 96, thus ensuring that the lifting arms 85 are turned synchronously. The lifting arms 85 are situated in the machine direction and are parallel with each other. Their outer and inner lifting arm parts 86, 87 form free edges along which the reeling drum 4 rolls during commencement and completion of the lift. A shock absorber 92 (see FIG. 17) is arranged at the transition between the outer and inner lifting arm parts 86, 87 in order to prevent the lifting arms 85 from being damaged as a result of the impact energy of the reeling drums 4 against the lifting arms 85, which shock absorber 92 comprises a curved impact absorber 93 and a damping member 94 for this in the form of a hydraulic cylinder. A plurality of detectors 40, 41 (see FIG. 16) are arranged on or close to each lifting arm 85 to detect some of the positions of the reeling drum 4 in the lifting arm 85 during its rolling movement therein. In the embodiment shown the detectors 40 are arranged to detect the position of the reeling drum in the V-shaped pocket to obtain a signal for continued lifting of the reeling drum 4 to the level of the rails 21 of the drum stock 15, i.e. the presence of both ends of the reeling drum 4 is registered by the detectors 40. The detectors 41 are arranged at the end of the inner lifting arm part 87 to detect the completion of the lift and subsequent delivery of the reeling drum 4 to the rails 21 of the drum stock 15 so that the lifting arms 85 can return to their lower fetching positions. A shock absorber 95 is also arranged at the end of the inner lifting arm part 87 in order to dampen the rolling-off movement of the reeling drum 4 from the lifting arms 85 onto the rails 21 of the drum stock 15. Blocking members 98 are arranged at suitable points along the rails 21, which blocking members 98 are arranged to be folded away under the influence of a reeling drum 4 rolling on the rails and then to return to their blocking position in which the reeling drum 4 is prevented from rolling backwards. The blocking members may be provided with springs or counterweights.

The handling station 54 also comprises a control and regulation unit of any type whatsoever (not shown), to which the detectors 40, 41, 46 and the actuators 90 are connected for activation and de-activation of the actuators 90 that operate the lifting arms. The other detectors 31, 33, 43 of the reel-up and other unillustrated detectors may also be connected to this control and regulation unit if so desired.

When the reeling process is initiated in the reel-up 1 (see FIG. 2), the primary arms 38 are in their upper, receiving position with their gripping members above the surface winding drum 9, the gripping member being open and ready to receive a first reeling drum 4. The secondary carriages 42 are in their upstream positions close to the surface winding drum 9. A first reeling drum 4 is located on the upper rails 21 above the surface winding drum 9, ready to be gripped by the lowering arms 32, the latter being still in their lowermost position. Downstream in the reel-up 1 the braking station 49 is ready with its braking arm 51, to receive and retard a finished jumbo roll 3. The cutting device has been started but is not in production position. Downstream and near the operator side of the reel-up 1 the first core 14 waits in its feed-in position in the core-feeding device 72 (see FIG. 3). The lifting table 58 is in its lowermost position and the furthermost core stop 110, in the direction of insertion of the core 14, is set to receive the first core 14 in a position on the lifting table 58 suited for the actual dividing of the paper web 2. A reeling drum 4, as yet without a core, is in the feed-in position in the drum moving device 60 at the side of the reel-up. The lifting arms 85 are in their lowermost position. The feeder 23 of the feeding device 22 is in a ready position at the entry end 99 of the drum stock 15 (see FIG. 16).

Figure 12:
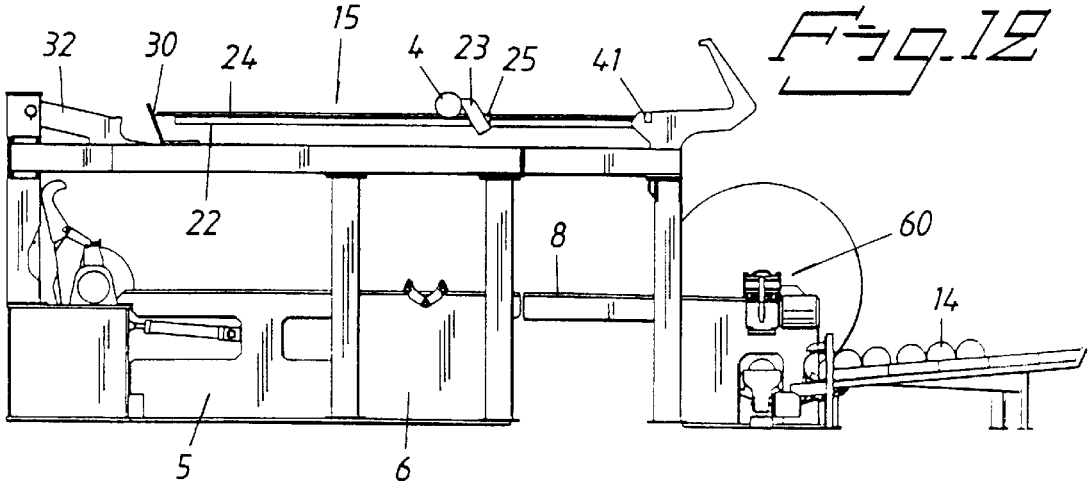
FIG. 12 shows a schematic side view of the reel-up of FIG. 1, depicted in a still further operating position.

When start has been initiated the lowering arms 32 move up to the drum stock 15 and the outermost of the reeling drums 4 in the drum stock 15 is lifted over the end stop 30 of the drum stock 15 by the lowering arms 32 (see FIGS. 1, 14, 15), after which the reeling drum 4 will roll along the roll surfaces 35 of the lowering arms 32 to the shock absorbers 37. The detectors 33 (see FIG. 1) indicate when the reeling drum has reached the correct position, whereupon the lowering arms 32 are turned down towards the lowering surfaces 39 (see FIG. 14) of the primary system, a distance above the surface winding drum 9, where the gripping devices of the primary arms 38 take over the reeling drum 4. During the downward movement the reeling drum 4 again rolls towards the grab hooks 36 of the lowering arms 32, but the latter have in the meanwhile been lowered sufficiently far to allow the reeling drum 4 free passage past the end stop 30 of the drum stock 15 and the next reeling drum 4 is now fed thus far by the feeding device 22 (see FIG. 12).

The press device 48 and locking device 47 of the primary arms 38 together encompass the reeling drum 4 and position it in its starting position. The reeling drum 4 is then accelerated up to the same peripheral speed as that of the surface winding drum 9 in order to minimise the friction when these are brought into contact with each other. When contact is made with the paper web 2 a wrapping occurs and the paper web 2 is transferred in suitable manner to the reeling drum 4, e.g. the paper reel 3 growing downstream (see FIG. 6) can be retarded so that a surplus appears in the web 2 which is drawn into the nip and then cut off. Alternatively the wrapping can be effected by glue or tape having been applied on the cores 14 of the reeling drum 4. If the paper web 2 is to be divided into several web sections 52, 53 (see FIG. 5), the cutter is started. While a number of turns of the paper web 2 are wound onto the reeling drum 4, this is moved by the primary arms 38 along the periphery of the surface winding drum 9 down to the stand parts 6, 7 (see FIGS. 4, 5) where the gripping members of the secondary system take over control of the reeling drum 4 (see FIG. 6). The lowering arms 32 are thus free to pass the primary lowered reeling drum 4 to be turned up to the drum stock 15 ready to fetch the next reeling drum 4 when a signal therefor is given.

While the paper reel 3 is growing the primary arms 38 first and then, after delivery of the reeling drum 4 to the secondary system, the secondary carriages 42, are gradually positioned outwardly from the surface winding drum 9. For the secondary system this means that the secondary carriages 42 move synchronously horizontally along the stand rails 8 (see FIG. 6).

When the paper reel 3 has reached its full size it rolls forward to the braking station 49 where it is gripped by the braking arms 51 (see FIG. 8). The reel 3 is now retarded to about 20% of production speed and the central drive is disconnected. The drive is stopped completely and the paper reel 3 is passed over to the handling station 54 by the ejection device 55 (see FIG. 10) and its arrival is detected by the detectors 43 (see FIG. 16).

The lifting table 58 and paper reel 3 are raised a short way from the rails 8 of the stand parts 6, 7 so that the reeling drum 4 is free from the stand 5 and the reeling drum 4 can be removed (see FIGS. 10 to 13) by its braking drum 10 on the operator side 6 being gripped by the gripping members 66 of the drum moving device 60. The plates of the reeling drum 4 are loosened, thus disengaging the cores 14, after which the gripping member 66 pulls out the reeling drum 4 to a rest position on the support element 62 (see FIGS. 11 and 13). The jumbo rolls 61 now released on the lifting table 58 are tipped out onto the bench 71 (see FIG. 15) by the inner and outer rows of actuators 59 of the lifting table 58 (see FIG. 7) being activated in opposite directions. A truck or overhead crane, for instance, then collects the paper reels 61.

A core 14 is caused to roll from the ramp 73 to the channel 78 situated downstream in rolling-out direction. The core 14 is then fed along the channel 78 with the aid of the feeder 82 in axial direction to the lifting table 58 (see FIG. 5). The core stop 110 of the lifting table 58 and its concave shape guarantee that the cores 14 arrive in the correct position on the lifting table 58. When the same number of cores 14 as there are cut web sections 52, 53 in the paper web 2 have thus been inserted axially one after the other on the lifting table 58 (see FIG. 5) and the lifting table 58 has been lifted by its actuators 59 to the level of the drum moving device 60, the latter's gripping member 66 again inserts the reeling drum 4 through all the cores 14 on the lifting table 58 to a rest position with each end of the reeling drum 4 on the stand rails 8 (see FIG. 7).

The machine operator causes the reeling drum 4 to expand, thereby firmly locking the cores 14 in the correct position for the cut web sections 52, 53 and the reeling drum 4 with its cores is then ready to be automatically transported up to the rails 21 of the drum stock 15 by the lifting device 84 at the downstream end of the reel-up 1. The lifting arms 85 are thus in their lowermost position, to which they are lowered each time a reeling drum 4 with its cores has been lifted up.

The actuators 90 of the lifting device 84 are activated during a short interval so that a first initial upward turning movement is achieved. The reeling drum 4 is gripped by each stop 91 on the lifting arms 85 and lifted a short distance so that the reeling drum 4 will be caused to roll slowly towards the pockets 89 formed between the outer and inner lifting arm parts 86, 87 (see FIGS. 8 and 9). When the reeling drum 4 has been gripped, the lifting table 58 is lowered to its lowermost position. The impact energy of the drum 4 caused by the rolling is taken up by the shock absorbers 92 (see FIG. 17) and when both ends of the reeling drum 4 have thus arrived in the pockets 89, the detectors 40 in the pockets indicate that the drum 4 is in the correct position for lifting.

Figure 17:
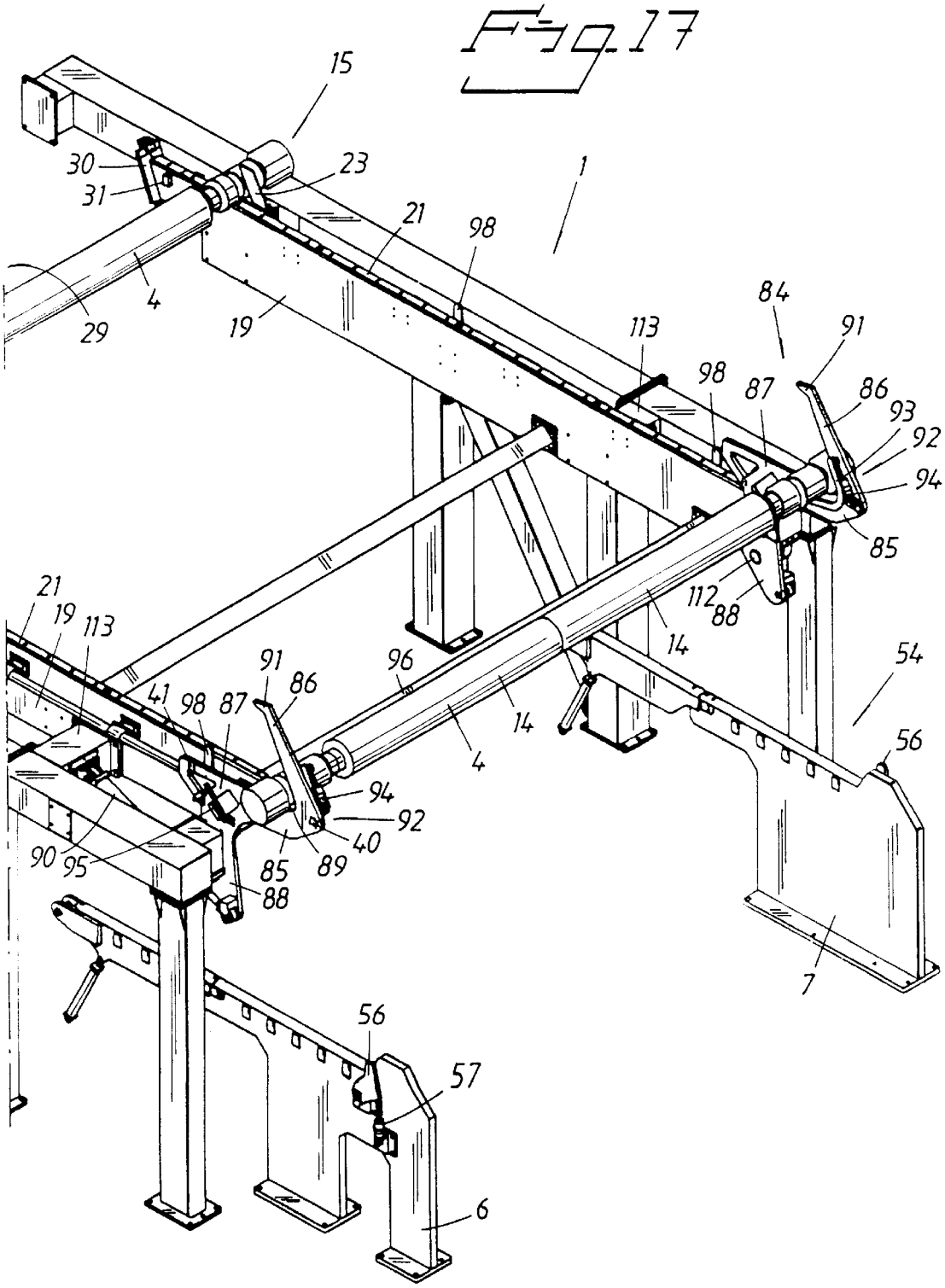
FIG. 17 shows a schematic perspective view of the parts of the reel-up and handling station at the downstream end of the reel-up.

The actuators 90 are once more activated and the reeling drum 4 lifted up to the entry 99 of the drum stock 15 where it rolls off the inner lifting arm parts 87 of the lifting arms 85, down onto the rails 21 (see FIGS. 11 and 17). The rolling movement is somewhat retarded by the shock absorbers 95. The detectors 41 indicate that the reeling drum 4 has been transferred to the stock 15 and the lifting arms 85 are then swung back to their lowermost positions.

The reeling drum 4 passes the blocking members 98 arranged on each rail 21 which, after having been folded aside during passage of the drum, are turned back to their upright blocking positions thereby preventing the reeling drum 4 from rolling back. Finally, the feeders 23 move the reeling drum 4 forward to the outlet 29 of the drum stock 15, either as far as the reeling drums 4 already there or to the end stop 30 (see FIG. 17). The detectors 31 indicate in the first case that both ends of the reeling drum 4 have reached the correct position.

The above-mentioned actuators may be hydraulic, pneumatic, electric or mechanical actuators.

Some or all of the parts of the handling station situated on the operator side may be placed on the drive side of the reel-up if so desired.

The reeling station of the reel-up may of course be designed in various known ways. In an alternative embodiment (not shown) the reel-up has no primary system and has instead double secondary units movable linearly along the machine stand, the secondary units alternately with each other receiving the reeling drums directly from the lowering arms. Each secondary unit then supports the reeling drum throughout the production phase from empty reeling drum to finished paper reel. Alternatively the secondary system may consist of only one pair of pivotable secondary arms.

Even if lifting elements in the form of pivotable lifting arms 85 are preferable both from the design and the function aspect, taking into consideration the limited space available near the reel-up, they can be designed and arranged differently, e.g. as lifting bars movable up and down in vertical guides.

Additional detectors to those described may be arranged at suitable points in the reel-up to detect the beginning or end of various phases or movements during reeling of the paper web and handling the reeling drums, cores and paper reels.

What is claimed is:

1. A reel-up in a paper machine for reeling a paper web successively onto a plurality of reeling drums provided with cores to form finished reels of paper, the reel-up having an upstream end and a downstream end and comprising:

a pair of parallel lower rails extending from the upstream end to the downstream end and adapted to support opposite end portions of each of the reeling drums and to permit the reeling drums to move along the lower rails;

a pair of parallel upper rails spaced above the lower rails and extending from the downstream end to the vicinity of the upstream end, the upper rails being adapted to support a stock of the reeling drums having opposite end portions arranged to move along the upper rails;

a reeling station arranged immediately downstream of the upstream end proximate the lower rails and operable for reeling the paper web onto each of the reeling drums as the reeling drums are successively placed in the reeling station; and a multi-functional handling station situated at the downstream end for handling said finished reels of paper, reeling drums and cores, the handling station comprising:

a drum-moving device operable to engage an end portion of the reeling drum in each said finished reel of paper positioned in the handling station and to remove the reeling drum from each said finished reel of paper, and further operable to insert the removed reeling drum into one or more empty cores aligned with the drum moving device;

a lifting table constructed and arranged to successively receive and support each of the finished reels of paper, the lifting table being movable for aligning the reeling drum of each said finished reel with the drum-moving device to permit removal of the reeling drum therefrom, the lifting table being further movable to align one or more of said empty cores with the drum-moving device to permit insertion of the removed reeling drum thereinto;

a core-feeding device operable for automatically feeding empty cores out onto the lifting table following removal of each of the finished reels of paper from the lifting table; and a lifting device operable to successively engage the end portions of each of the reeling drums provided with at least one empty core and situated on the lifting table, and to successively lift each of the reeling drums and deliver it to the upper rails.

2. The reel-up of claim 1, wherein the handling station includes a plurality of detecting devices operable to provide signals indicative of various positions of the reeling drum for control and adjustment of movement and stop positions of the lifting device.

3. The reel-up of claim 2, wherein the detecting devices comprise:

first detectors operable to detect the presence of each reeling drum provided with at least one empty core and positioned on the lifting table, in order to initiate activation of the lifting device to engage the end portions of the reeling drum; and second detectors operable to detect a predetermined position of the reeling drum on the lifting device to initiate activation of the lifting device to lift and deliver the reeling drum to the upper pair of rails.

4. The reel-up of claim 2, wherein the handling station includes a control and adjustment unit to which the detecting devices and lifting device are connected to activate and de-activate the lifting device.

5. The reel-up of claim 1, wherein the lifting device includes lifting arms pivotably journalled in the reel-up so as to permit rotation of the lifting arms from a lower position for engaging each reeling drum located on the lifting table to an upper position for delivering the reeling drum to the upper rails.

6. The reel-up of claim 5, wherein each of the pivotably mounted lifting arms comprises an outer lifting arm part and an inner lifting arm part, the outer lifting arm part being configured to engage each reeling drum located on the lifting table when the lifting arm is in the lower position, the inner lifting arm part being configured to permit the reeling drum to roll therealong onto the upper rails when the lifting arm is in the upper position.

7. The reel-up of claim 6, wherein the outer and inner lifting arm parts form an acute angle with each other to define a V-shaped pocket.

8. The reel-up of claim 6, wherein the outer lifting arm part of the lifting arm has a free outer end defining a stop for preventing the reeling drum from rolling off the outer lifting arm part.

9. The reel-up of claim 6, wherein a first shock absorber is arranged at a juncture between the outer and inner lifting arm parts for damping rolling motion of each reeling drum held in the lifting arms.

10. The reel-up of claim 9, wherein a second shock absorber is arranged at an inner portion of the inner lifting arm part for damping rolling motion of the reeling drum as the reeling drum rolls from the lifting arm onto the upper rails.

11. The reel-up of claim 1, wherein the lifting table is vertically movable from a lowered position for receiving each finished reel of paper to an intermediate raised position for raising the opposite end portions of the reeling drum of each finished reel above the lower rails to align the reeling drum with the drum-moving device.

12. The reel-up of claim 11, wherein the core-feeding device comprises a conveyor constructed and arranged to feed an empty core onto the lifting table when the lifting table is in the intermediate raised position.

13. The reel-up of claim 12, wherein the lifting table is vertically movable into an uppermost raised position for aligning said empty cores with the drum-moving device, and wherein the lifting device is arranged to pick up each reeling drum from the lifting table while the lifting table is in the uppermost raised position.

14. A multi-functional handling station for a reel-up of a paper making machine of the type having a pair of upper rails for supporting a stock of reeling drums each provided with one or more cores, a pair of lower rails below the upper rails and having an upstream end proximate a reeling device operable to reel a web of paper successively onto each of the reeling drums as each reeling drum is placed in the reeling device so as to form finished reels of paper, the reeling device further being operable to move each finished reel of paper along the lower rails to a downstream end, the handling station comprising:

a lifting table adapted to be positioned proximate the downstream end of the lower rails for receiving each finished reel of paper, the lifting table being vertically movable from a lowered position for receiving each finished reel to an intermediate raised position for raising the finished reel to free the reeling drum in the finished reel from the lower rails;

a drum-moving device aligned with the reeling drum in the finished reel of paper supported on the lifting table in the intermediate raised position, the drum-moving device being operable to engage an end portion of the reeling drum and to remove the reeling drum from the finished reel of paper, and further operable to insert the removed reeling drum into one or more empty cores aligned with the drum moving device;

a core-feeding device operable for automatically feeding empty cores out onto the lifting table following removal of each finished reel of paper from the lifting table; and a lifting device operable to engage the end portion of each reeling drum provided with at least one empty core and situated on the lifting table, and to lift the reeling drum and deliver it to the upper rails.

15. The handling station of claim 14, wherein the core-feeding device comprises a conveyor constructed and arranged to feed an empty core onto the lifting table when the lifting table is in the intermediate raised position.

16. The reel-up of claim 14, wherein the lifting table is vertically movable into an uppermost raised position for aligning each empty core situated on the lifting table with the drum-moving device, and wherein the lifting device is arranged to pick up each reeling drum from the lifting table while the lifting table is in the uppermost raised position.

17. The reel-up of claim 14, wherein the lifting device comprises a pair of lifting arms adapted to be pivotally connected to the reel-up, the lifting arms being pivotally movable to engage each reeling drum located on the lifting table and to raise the reeling drum and deliver the reeling drum onto the upper rails.

* * * * *